US009344803B1

(12) United States Patent
Palenzuela

(10) Patent No.: US 9,344,803 B1
(45) Date of Patent: May 17, 2016

(54) EASY MOUNTING CONFIGURATION FOR LOUDSPEAKER

(76) Inventor: Gonzalo Palenzuela, Coral Gables, FL (US)

( * ) Notice: Subject to any disclaimer, the term of this patent is extended or adjusted under 35 U.S.C. 154(b) by 457 days.

(21) Appl. No.: 13/529,734

(22) Filed: Jun. 21, 2012

(51) Int. Cl.
*H04R 1/06* (2006.01)
*H04R 9/02* (2006.01)

(52) U.S. Cl.
CPC ..... *H04R 9/022* (2013.01)

(58) Field of Classification Search
CPC ..... H04R 9/022
USPC ..... 381/394, 192, 396, 401, 400
See application file for complete search history.

(56) References Cited

U.S. PATENT DOCUMENTS

| | | | |
|---|---|---|---|
| 1,952,188 | A | 3/1934 | Watts |
| D137,704 | S | 4/1944 | Drury |
| D188,102 | S | 6/1960 | Yarick |
| D188,542 | S | 8/1960 | Levy |
| 3,203,542 | A | 8/1965 | Lightner et al. |
| 3,301,395 | A | 1/1967 | Swezey |
| 3,366,917 | A | 1/1968 | Karol |
| 3,404,774 | A | 10/1968 | Levine |
| 3,666,134 | A | 5/1972 | Rauch |
| 3,684,052 | A | 8/1972 | Sotome |
| D225,069 | S | 11/1972 | May |
| 4,002,836 | A | 1/1977 | Gardner |
| 4,105,865 | A | 8/1978 | Guillory |
| 4,196,314 | A | 4/1980 | Guillory |
| 4,590,332 | A | 5/1986 | Delbuck |
| 4,702,374 | A | 10/1987 | Kelner |
| D292,879 | S | 11/1987 | Smith |
| 4,815,558 | A | 3/1989 | Krainhofer |
| D305,532 | S | 1/1990 | Gallo et al. |
| D315,543 | S | 3/1991 | Soren et al. |
| 5,052,558 | A | 10/1991 | Carter |
| 5,064,268 | A | 11/1991 | Morency et al. |
| D325,023 | S | 3/1992 | Lee et al. |
| D328,280 | S | 7/1992 | Lee |
| D329,042 | S | 9/1992 | Van der Burgh |
| D332,088 | S | 12/1992 | Nimpoeno et al. |
| D334,172 | S | 3/1993 | Wilcoxon |
| D355,639 | S | 2/1995 | Cheng |
| D360,620 | S | 7/1995 | Gehrs et al. |
| D360,877 | S | 8/1995 | Ropponen et al. |
| D366,863 | S | 2/1996 | Lee |
| D367,036 | S | 2/1996 | Lee |
| 5,529,513 | A | 6/1996 | Lee |
| D371,762 | S | 7/1996 | Lee |
| D374,862 | S | 10/1996 | Lee |
| D376,580 | S | 12/1996 | Lee |
| D381,010 | S | 7/1997 | Ansley |
| 5,648,749 | A | 7/1997 | Lin et al. |

(Continued)

*Primary Examiner* — Duc Nguyen
*Assistant Examiner* — Phan Le
(74) *Attorney, Agent, or Firm* — Malloy & Malloy, P.L.

(57) ABSTRACT

A loudspeaker assembly preferably, but not necessarily, structured to be operative as a tweeter and including a base which may be formed of a magnet in conformance with the operability of a tweeter. One or more terminals are connected to the base and at least a corresponding number of recesses are formed in an exterior sidewall surface thereof. Each of the one or more terminals is disposed in aligned relation with a correspondingly disposed one of said recesses, wherein aligned ones of said terminals and said recesses are cooperatively disposed and structured to facilitate conformance of the one or more terminals with the circumferential configuration of the exterior sidewall of the base.

6 Claims, 3 Drawing Sheets

(56) References Cited

U.S. PATENT DOCUMENTS

| | | | | |
|---|---|---|---|---|
| 5,687,247 | A | 11/1997 | Proni | |
| D390,831 | S | 2/1998 | Liang | |
| D393,641 | S | 4/1998 | Hai-Fu | |
| D403,302 | S | 12/1998 | Awbrey | |
| D405,050 | S | 2/1999 | Lee | |
| D406,569 | S | 3/1999 | Awbrey et al. | |
| 5,888,098 | A | 3/1999 | Cheng et al. | |
| D413,569 | S | 9/1999 | Peterson et al. | |
| D414,462 | S | 9/1999 | Peterson et al. | |
| 5,949,898 | A | 9/1999 | Proni | |
| 5,959,250 | A | 9/1999 | Daoud | |
| 6,019,167 | A | 2/2000 | Bishop et al. | |
| D425,023 | S | 5/2000 | Awbrey | |
| D429,638 | S | 8/2000 | Li et al. | |
| D430,850 | S | 9/2000 | Alves et al. | |
| 6,118,884 | A | 9/2000 | Proni | |
| D432,118 | S | 10/2000 | Honnert | |
| D434,009 | S | 11/2000 | Lee | |
| D435,512 | S | 12/2000 | Cheng | |
| D435,513 | S | 12/2000 | Cheng | |
| D436,077 | S | 1/2001 | Cheng | |
| D437,586 | S | 2/2001 | Sonntag | |
| 6,219,431 | B1 | 4/2001 | Proni | |
| 6,229,902 | B1 | 5/2001 | Proni | |
| 6,239,956 | B1 | 5/2001 | Shirai et al. | |
| 6,243,479 | B1 | 6/2001 | Proni | |
| 6,276,529 | B1 | 8/2001 | Feehan, Jr. | |
| D448,017 | S | 9/2001 | Hasbrook | |
| D449,226 | S | 10/2001 | Hedstrom et al. | |
| D450,297 | S | 11/2001 | Lee | |
| D450,666 | S | 11/2001 | Scribner | |
| D453,322 | S | 2/2002 | Lee | |
| D456,363 | S | 4/2002 | Lee | |
| 6,406,313 | B1 | 6/2002 | Victor | |
| 6,496,590 | B2 | 12/2002 | Proni | |
| 6,501,844 | B2 | 12/2002 | Proni | |
| D472,462 | S | 4/2003 | Atkin et al. | |
| D472,545 | S | 4/2003 | Iijima et al. | |
| D472,891 | S | 4/2003 | Proni | |
| D473,216 | S | 4/2003 | Irby et al. | |
| D475,992 | S | 6/2003 | Tomotaro | |
| 6,611,605 | B2 * | 8/2003 | Kim | 381/406 |
| 6,618,268 | B2 | 9/2003 | Dibene, II et al. | |
| D482,667 | S | 11/2003 | Yu | |
| D484,116 | S | 12/2003 | Proni | |
| D487,738 | S | 3/2004 | Iijima et al. | |
| D488,802 | S | 4/2004 | Uehara et al. | |
| D490,381 | S | 5/2004 | Dejan | |
| D493,161 | S | 7/2004 | Iijima et al. | |
| D493,445 | S | 7/2004 | Iijima et al. | |
| D494,858 | S | 8/2004 | Rosler | |
| 6,868,165 | B1 * | 3/2005 | Fabian | H04R 9/022 381/397 |
| D508,027 | S | 8/2005 | Shingt | |
| D508,237 | S | 8/2005 | Shing | |
| D518,796 | S | 4/2006 | Shingt | |
| D519,026 | S | 4/2006 | Shing | |
| D519,077 | S | 4/2006 | Disbennett et al. | |
| D523,848 | S | 6/2006 | Shing | |
| D528,506 | S | 9/2006 | Taguchi | |
| D530,669 | S | 10/2006 | Shing | |
| D532,749 | S | 11/2006 | Shing | |
| D535,979 | S | 1/2007 | Shing | |
| D544,837 | S | 6/2007 | Disbennett et al. | |
| D565,550 | S | 4/2008 | Tai | |
| D578,477 | S | 10/2008 | Shing et al. | |
| D580,356 | S | 11/2008 | Shing et al. | |
| D582,893 | S | 12/2008 | Tai | |
| 8,126,185 | B1 | 2/2012 | Dai et al. | |
| 8,130,997 | B1 | 3/2012 | Dai et al. | |
| 2002/0148678 | A1 | 10/2002 | Sahyoun | |
| 2006/0233417 | A1 * | 10/2006 | Steere | H04R 1/06 381/409 |
| 2007/0121993 | A1 * | 5/2007 | Horigome et al. | 381/396 |
| 2007/0237351 | A1 * | 10/2007 | Hyde | H04R 9/022 381/397 |
| 2009/0324000 | A1 | 12/2009 | Espiritu | |
| 2011/0135140 | A1 * | 6/2011 | Tanabe | 381/400 |

* cited by examiner

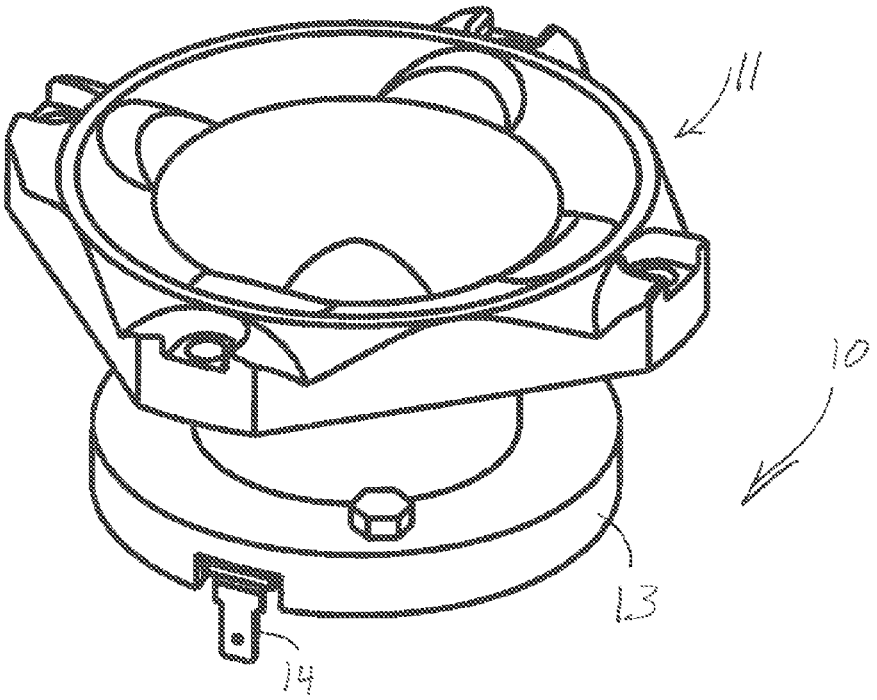
FIG 1
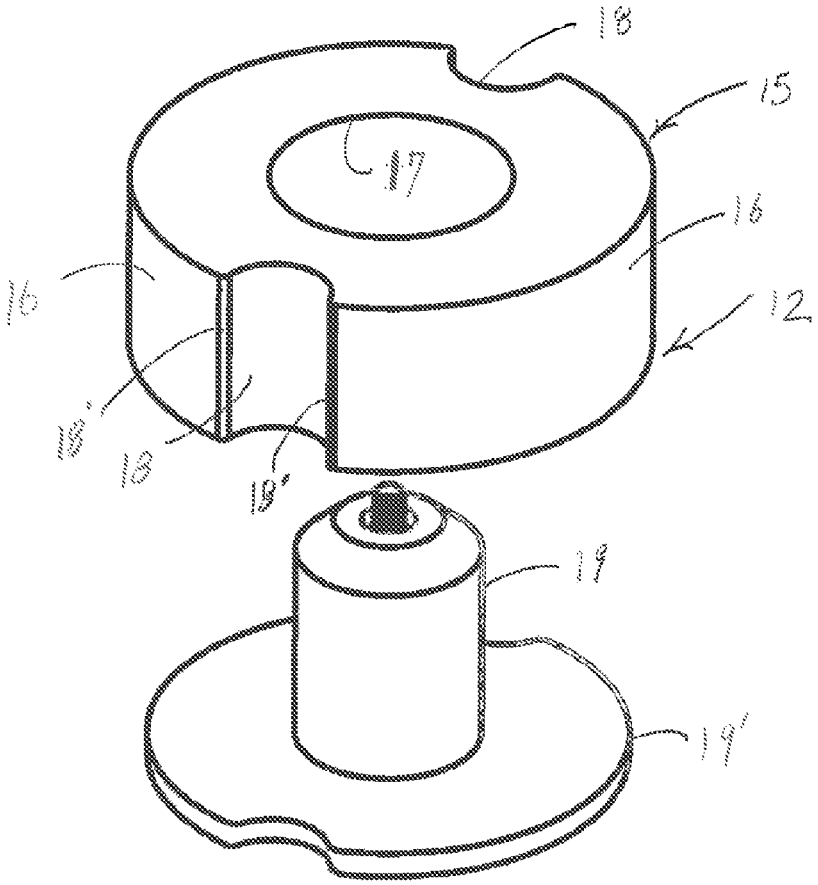

FIG 5
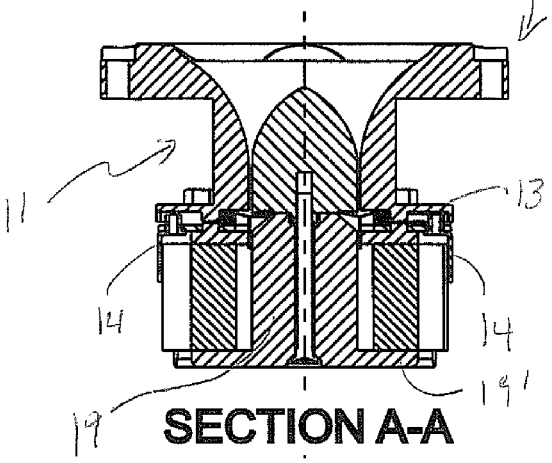
FIG 2
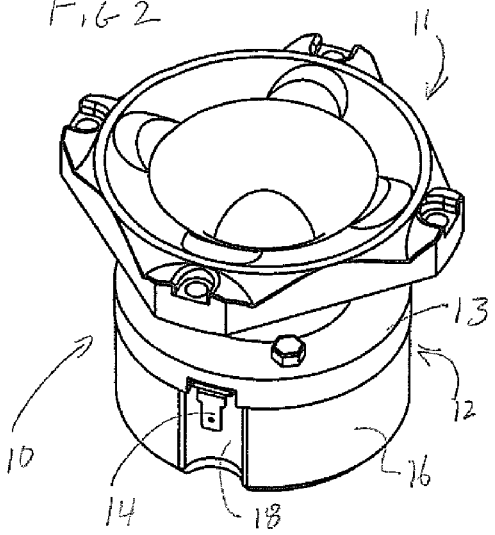
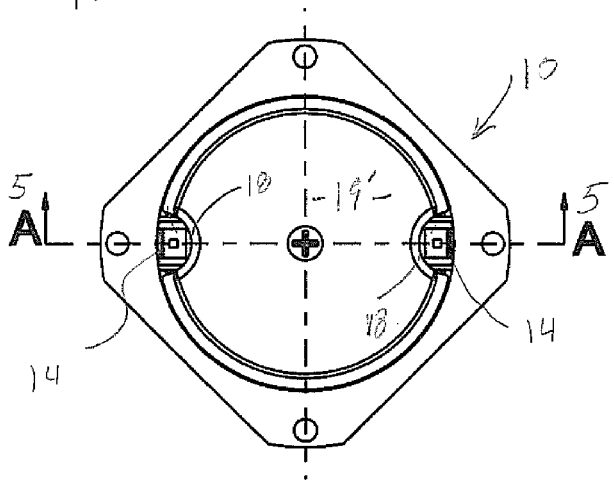
FIG 4
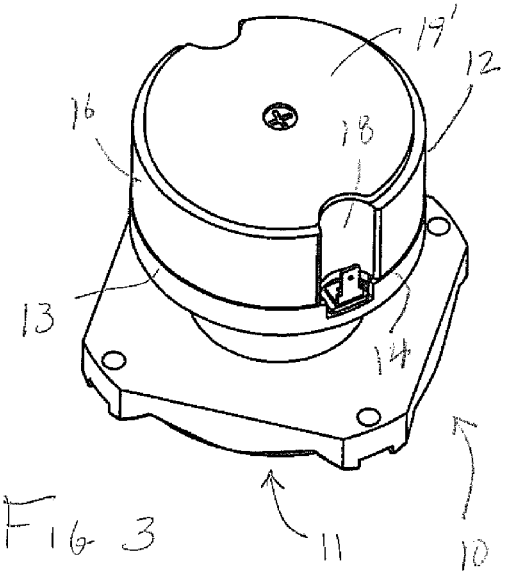
FIG 3

FIG. 7
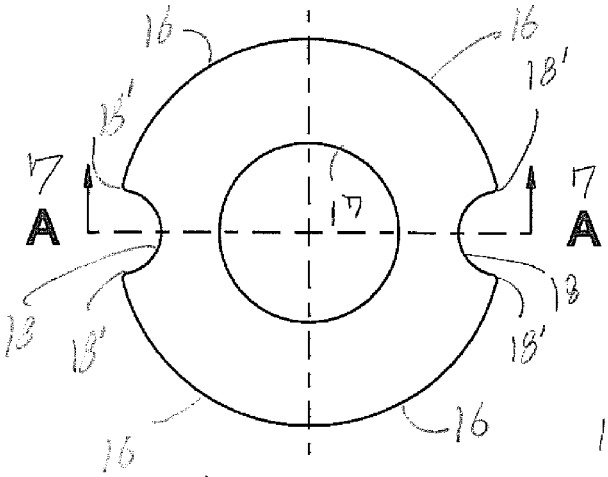
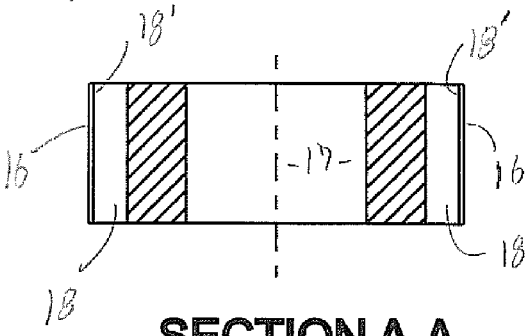
SECTION A-A
FIG. 8
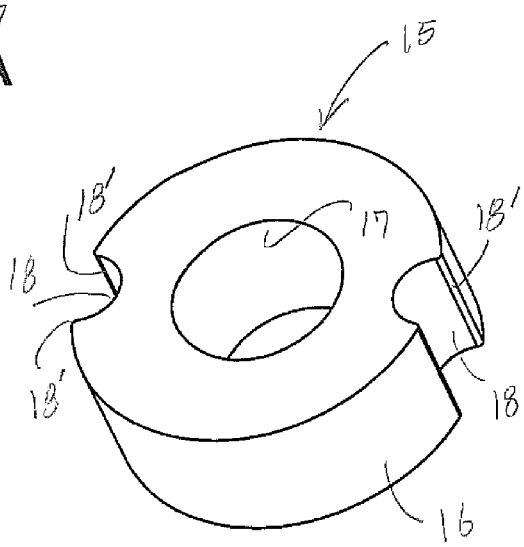
FIG. 6

EASY MOUNTING CONFIGURATION FOR LOUDSPEAKER

BACKGROUND OF THE INVENTION

1. Field of the Invention

This invention is directed to a loudspeaker assembly, which may be structured, but is not limited, to operate as a tweeter and includes a base having at least one or more terminals connected to the operative components of the loudspeaker. The one or more terminals are longitudinally aligned with a central axis of the base due at least partially to their cooperative position and orientation relative to corresponding, elongated recesses or channels formed in the exterior side wall of the base, or more specifically, the fixed magnet of the tweeter. As such, the plurality of terminals are oriented to substantially conform to the circumferential configuration of the exterior wall surface of the base, thereby facilitating the mounting of the assembly into a supporting structure.

2. Description of the Related Art

As well recognized, a tweeter is a loudspeaker structure designed to produce high audio frequencies typically in the frequency ranges of substantially 2000 Hz to 20000 Hz, the latter frequency range considered to be the upper limit of human hearing. The name "tweeter" is derived from the high pitched sounds made by some birds, especially in contrast to the low "woof" sound made by many dogs. As such, the "woofer" structure is the name given to low frequency drivers.

Tweeters are electrodynamic drivers using a voice coil disposed within a fixed magnetic field. Such structures are operative by applying a current from an output of an amplifier circuit to a coil or wire, typically referred to as a voice coil. Interconnection between the current supply and the voice coil may be accomplished by one but more practically a plurality of terminals. Further with regard to the operation of the conventional tweeter assembly, the voice coil produces varying magnetic fields which works against the magnetic field of a fixed magnet surrounding the cylindrical voice coil. As a result the voice coil and the diaphragm attached thereto will vibrate.

Vibration or mechanical movement resembles the wave form of the electronic signal supplied from the amplifiers output to the voice coil. Due to the fact that the coil is attached to the diaphragm the vibratory motion of the voice coil transmits to the diaphragm, wherein the diaphragm in turn vibrates the surrounding air. As a result the vibrating air motion or "audio waves" result in the aforementioned high pitched sounds.

As tweeter technology has advanced, differently designed applications have become popular. However, common to most known or conventional tweeter construction is the inclusion of the aforementioned terminals. However, one problem or disadvantage associated with known tweeter construction is the orientation of the terminals to extend substantially transversely outward from the exterior of the base or fixed magnet and/or more specifically outwardly from the exterior wall surface thereof. As a result, when mounting the tweeter onto a supporting structure, additional care, time and effort must be utilized. More specifically, the mounting of the tweeter may involve the formation of a hole, aperture, etc., in the supporting structure, such that the base of the tweeter may at least partially pass there through. However, in order to accommodate a conventional tweeter assembly, additional cutting or forming procedures must be performed on the supporting structure to allow for the transversely oriented, outwardly extending terminals.

Therefore, in order to overcome the above noted problems or disadvantages associated with conventional or known tweeter or other loudspeaker constructions, there is a need for an improved terminal structure to be incorporated in a tweeter or other loudspeaker assembly. Such an improved and proposed terminal structure may include the cooperative orientation and disposition of the terminals with the base in a manner which facilitates the mounting of the loudspeaker into a supporting structure. Moreover, the improved terminal structure overcomes or eliminates the need to perform additional forming, cutting or shaping procedures on the supporting structure.

Accordingly, a proposed and improved tweeter or other loudspeaker assembly may comprise the structuring and/or orientation of the terminals thereof in a manner which substantially conforms to the substantially round or circular circumferential configuration of the exterior sidewall of the base. As such, a corresponding round or circular hole, aperture or the like may be formed in the supporting structure. The mounting or supporting aperture has a peripheral configuration substantially conforming to the circumferential configuration of the exterior wall surface of the base. As a result the proposed and improved tweeter structure eliminates or significantly reduces the problems and disadvantages as set forth above.

SUMMARY OF THE INVENTION

The present invention is directed to a loudspeaker assembly, which may be structured to be operative as a tweeter or other type of loudspeaker. As generally accepted loudspeakers are structurally designed to produce sounds at different frequencies. As such, loudspeaker constructions intended to operate at high frequencies are referred to as "tweeters"; at low frequencies are referred to as "woofers", etc. Other loudspeakers are designed to operate at or within other frequency ranges. However, many known loudspeaker constructions and designs include a voice coil disposed with in a fixed magnet.

Accordingly, the present invention is directed to a loudspeaker assembly which may be structured to operate within any one of a plurality of different and/or acceptable frequency ranges. As such the loudspeaker assembly of the present invention comprises a base, which may include or be defined by a fixed magnet disposed in surrounding relation to a voice coil. In addition, at least one but more practically a plurality of terminals are operatively connected to the base and are specifically disposed, structured and oriented to facilitate the mounting or attachment of the loudspeaker to a supporting structure.

A conventional loudspeaker design and structure may include one or more terminals extending transversely outward from the sidewall or other exterior portions of the base. In contrast, one feature of the present invention is the disposition and/or orientation of the terminals so as to substantially conform to the circumference or "circumferential configuration," of the exterior of the base. As a result, the base of the loudspeaker can be more easily installed into any appropriate supporting structure by forming a hole or aperture having a circumference dimensioned and configured to conform to the base. In that the base of a tweeter or other loudspeaker may normally have a substantially round or circular exterior wall surface, the mounting hole or aperture of the supporting structure may also have a substantially round or circular configuration and be correspondingly or cooperatively dimensioned to receive at least a portion of the base there through. Therefore, due to the fact that the terminals of the present invention are oriented to be aligned with and/or conform to the circumference of the exterior wall surface of the base, any extra cutting, forming or shaping of the supporting structure for the loudspeaker will be eliminated or significantly reduced. As a result the mounting or attachment of the loudspeaker assembly of the present invention is facilitated.

Additional features of the present invention include the base comprising a one or more recesses, preferably corresponding in number to the number of terminals, and being integrally or otherwise appropriately formed in the exterior wall surface of the base or magnet. Moreover, each of the recesses is disposed in aligned relation with a different one of the terminals. More specifically, the aligned relation between correspondingly disposed ones of the terminals and recesses may be more specifically described as a longitudinal alignment therebetween. As such, each of the terminals has at least a majority of its length disposed in aligned, immediately adjacent relation to a length of the correspondingly disposed recess. As described in greater detail hereinafter, each of the terminals may be disposed substantially adjacent or contiguous an outer, open face or outer peripheral boundary of the corresponding recess. In the alternative, each of the terminals may be disposed at least partially and/or minimally within corresponding ones of the recesses such as, but not limited to, an adjacent relation to the outer, open face or periphery.

It is to be noted that the recesses may assume a variety of different dimensions and configurations, while having the common structural features of being formed in the exterior wall surface of the base. Moreover, each or at least some of the plurality of recesses may be in the form of substantially elongated channels extending along at least a portion of the "height" of the exterior wall of the base, in substantially transverse relation to the circumference thereof. In cooperation therewith and as at least partially set forth above, correspondingly disposed ones of the terminals may be disposed in aligned or adjacent relation with the outer, open peripheral face or at least partially or entirely within the corresponding recess of the base. In either embodiment, at least a majority of the length of the terminal will be disposed in longitudinally aligned relation with the length of the recess or channel and may even be in substantially parallel relation to the central axis and/or length of the corresponding recess or channel.

Such cooperative positioning of the terminals and corresponding recesses results in the lengths of the terminal and recesses being oriented in the same "direction". As a further result, the length of each of the terminals is disposed or oriented to substantially conform to the circumference with the exterior wall surface of the base. In more specific terms, the cooperative disposition, structuring and orientation of correspondingly disposed ones of the terminals and recesses/channels are such that each terminal substantially conforms to "circumferential configuration" of the exterior wall surface of the base. As set forth above, this is in contrast to a typical or commercial structuring of a tweeter, woofer or other loudspeakers, wherein the terminals thereof normally extend transversely outward from the exterior wall of the base. Such transversely oriented terminals thereby substantially restrict the mounting of a corresponding loudspeaker in a supporting structure, such as through a receiving aperture having a circumferential configuration corresponding to that of the exterior wall of the base.

The circumferential conformance of each of the terminals with the exterior wall surface of the base, of the present invention, is meant to include a position of the terminals at any appropriate location adjacent or corresponding to opposite ends of the corresponding recess or intermediate the opposite ends, while still being disposed in conformance with the circumferential configuration of the exterior wall surface of the base. As practically applied and/or commercially developed, one or more preferred embodiments of the present invention may be known as or referred to under the brand name "Audiopipe".

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view in exploded, non-assembled form of one preferred embodiment of the present invention including one or more terminals of a loudspeaker assembly disposed in an orientation which conforms to the circumferential configuration of the base.

FIG. 2 is a top perspective view of in assembled form of the embodiment of FIG. 1.

FIG. 3 is a bottom perspective view of the embodiment of FIG. 2.

FIG. 4 is a bottom plan view of the embodiment of FIGS. 1-3.

FIG. 5 is a sectional view taken along line 5A-5A of FIG. 4.

FIG. 6 is a perspective view of a portion of the base, which may be in the form of a fixed magnet, of the embodiment of FIGS. 1-5.

FIG. 7 is a top plan view of the embodiment of FIG. 6.

FIG. 8 is a sectional view taken along line 7A-7A of FIG. 7.

Like reference numerals refer to like parts throughout the several views of the drawings.

DETAILED DESCRIPTION OF THE PREFERRED EMBODIMENT

As shown in FIGS. 1 and 2 of the accompanying drawings, the present invention is directed to a loudspeaker assembly preferably generally indicated as 10. As set forth above, the loudspeaker 10 may be structured and designed to operate as a tweeter, woofer, or other loudspeaker structure intended to function within different frequency ranges. As such, the loudspeaker assembly 10 may comprise, but is not limited to, the inclusion of a diaphragm and supporting frame, collectively and generally indicated as 11 having a mounting plate or member 13. In addition the speaker assembly 10 comprises a base 12, which may be included and be at least partially defined by a fixed magnet 15, represented in greater detail in FIGS. 6-8. The base 12 and or magnet 15 may include an aperture 17, through which other operative components including a voice coil 19 is disposed. The voice coil 19 may be connected to a plate 19' or other appropriate structure facilitating the interconnection and assembly of the base 12. Operational features associated with the loudspeaker assembly 10 include the voice coil being cooperatively disposed relative to the magnet 15 and other components of the base 12 to produce sound within the intended frequency range.

As set forth above, conventional loudspeakers include at least one but more practically a plurality of terminals are operatively connected to and extend substantially transversely outward from an external surface or external sidewall thereof. However, as indicated, such a transverse, outwardly protruding orientation of the one or more terminals results in disadvantages and/or problems relating to the mounting in any of a variety of different types of supporting structures.

Therefore, one feature of the loudspeaker assembly 10 of the present invention, as represented in the accompanying Figures, includes at least one but more practically a plurality of terminals 14 having a predetermined, cooperative structure relative to a remainder of the base 12, including the magnet 15, when incorporated in the base 12. More specifically, each of the one or more terminals 14 are oriented to substantially conform to the curvature or circumferential configuration of the exterior sidewall surface 16 of the base 12 and/or magnet 15. More specifically, the orientation of the one or more terminals 14, being in conformance with the curvature and/or other surface configuration of the sidewall 16, is in direct contrast to the outwardly protruding, transversely oriented terminals, which may be found in conventional loudspeaker construction and design.

In at least one embodiment of the present invention, structural and operative features include at least one or a corresponding number of recesses, each indicated as 18, formed in the exterior wall 16. As also represented, the recesses 18 extend inwardly from the outer peripheral surface of the sidewall 16. Recesses 18 may be in the form of substantially elongated channels extending along at least a portion of the height of the exterior sidewall 16, such as between and possibly including plate or member 19' and the mounting base 12. Accordingly, the length of the recesses or channels 18 may be disposed in transverse relation to the length of the circumference of the exterior sidewall 16. It is emphasized, that the configuration and dimension of the recesses or channels may vary, but still accommodate an orientation and/or disposition of the terminals 14 so as to individually and collectively substantially correspond to and conform with the circumferential configuration of the outer surface of the exterior sidewall 16 of the base 12 and/or magnet 15.

In addition each of the one or more recesses 18 are formed in corresponding, immediately adjacent or at least partially enclosing relation to each of the one or more terminals 14. Such adjacent or corresponding disposition and orientation facilitates the positioning of each of the terminals 14 at least partially within the interior of the recess or channel 18 or in substantially alignment with the outer, open face thereof, as at 18'.

As clearly represented, the one or more recesses or channels 18 can be integrally formed in the exterior sidewall 16 of the magnet 15, such that the open, outer face 18' thereof are substantially within and/or coincident with the circumferential configuration of the outer surface of the sidewall 16. This further allows the orientation of the corresponding one or more terminals 14 into alignment with the open face 18' of the recess or channel or at least partially recessed inwardly there from and into the interior of the corresponding recess 18.

In more specific terms, the preferred, longitudinal alignment of the one or more terminals 14 with the recess or channel 18 may also, but not necessarily, correspond to the longitudinal alignment of the one or more terminals 14 with the central axis of the base 12, as the central axis extends between the opposite ends 12' and 12". Therefore, at least a majority of the length of each of the one or more majority of the length of the correspondingly disposed, one or more recesses 18. In turn and in cooperation therewith, the one or more terminals 14 and the correspondingly disposed one or more recesses or channels 18 may also be disposed in substantially longitudinal alignment with the central axis of the base 12.

Accordingly, a comparison of the loudspeaker assembly or tweeter structure 10 in the embodiments of FIGS. 1 and 2 with the prior art structure, as described above, clearly indicates the contrasting orientations of the one or more terminals 18. As such, the orientation of the terminals 18 of the preferred embodiments of FIGS. 1 and 2 will substantially conform to the circumferential configuration of the exterior wall surface 16. This will allow an easier, less time consuming installation procedure or technique to occur in that the peripheral configuration of a mounting or supporting aperture in the corresponding supporting structure will still substantially conform to the circumferential configuration of the outer wall surface 16. This in turn will eliminate the necessity, additional, time consuming forming or cutting techniques typically required in accommodating the placement of the outwardly protruding transversely oriented terminal 14 in prior art loudspeaker and tweeter assemblies.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A loudspeaker assembly comprising:

a base including a magnet cooperatively structured with a remainder of the loudspeaker to function as a tweeter, said base having a substantially continuous exterior sidewall; said exterior sidewall including an exposed exterior surface at least partially defining an outer circumference of an exterior of said base, said base including a plurality of recesses formed in said exposed exterior surface of said exterior sidewall in spaced relation to one another, each of said plurality of recesses comprising an elongated channel integrally formed in said exterior sidewall in recessed relation to said exposed exterior surface thereof, each of said plurality of channels including an open, exterior face disposed in aligned, coincident relation with said exposed exterior surface of said exterior sidewall, a plurality of terminals connected to said base and each of said plurality of terminals at least partially disposed within a correspondingly disposed one of said channels in an exteriorly exposed position through a corresponding open face, the length of each of said channels extending along at least a majority of a height of said exterior sidewall in transverse relation to a circumferential length of said exposed exterior surface and said exterior sidewall, each of said channels and corresponding ones of said plurality of terminals disposed in longitudinally aligned relation to one another and in substantially longitudinally aligned relation to a central axis of said base, and each of said plurality of terminals disposed in substantial conformance with a circumferential configuration of said external sidewall and said exposed exterior surface of said base.

2. A loudspeaker assembly as recited in claim 1 wherein said longitudinally aligned relation comprises at least a majority of a length of each of said plurality of terminals disposed in longitudinally aligned relation with the length of corresponding ones of said channels and the central axis of said base.

3. A loudspeaker assembly as recited in claim 2 wherein said longitudinally aligned relation comprises at least the majority of the length of each of said plurality of terminals is disposed in substantially parallel relation with a longitudinal axis of said channel.

4. A loudspeaker assembly as recited in claim 1 wherein each of said plurality of terminals is disposed in substantially aligned relation with said corresponding open, exterior face of a corresponding one of said channels.

5. A loudspeaker assembly comprising:

a base including a fixed magnet cooperatively structured with a remainder of said loudspeaker to define and function as a tweeter, said magnet including an exterior sidewall having an exposed exterior surface, said exposed exterior surface at least partially defining an outer circumference of said magnet, a plurality of terminals connected to said magnet, a plurality of channels integrally formed in said exterior sidewall in inwardly recessed relation to said exposed exterior surface of said exterior sidewall of said magnet, each of said plurality of channels including an open, exterior face disposed in aligned, coincident relation to said exposed exterior surface of said magnet, each of said plurality of terminals disposed at least partially within and in longitudinally aligned relation with a different, correspondingly disposed one of said plurality of channels and in an exposed position relative to a corresponding exterior, open face thereof, and said longitudinally aligned ones of said plurality of terminals and said plurality of channels disposed in longitudinally aligned relation with a central axis of said magnet.

6. A loudspeaker assembly as recited in claim 5 wherein said plurality of terminals and said plurality of channels disposed and oriented to substantially conform to a circumferential configuration of said exposed exterior surface of said exterior sidewall of said magnet.

* * * * *